US005733625A

United States Patent [19]

Tsuchiya et al.

[11] Patent Number: 5,733,625

[45] Date of Patent: Mar. 31, 1998

[54] NON-WOVEN FABRIC

[75] Inventors: Hideo Tsuchiya, Moriyama; Mitsuru Fujihashi, Souwa-machi; Yoshisato Miyakoshi, Souwa-machi; Takahiro Yokoyama, Souwa-machi; Toshiaki Hirohashi, Souwa-machi; Noriko Miyaguchi, Kasukabe, all of Japan

[73] Assignee: Japan Vilene Company, Ltd., Tokyo, Japan

[21] Appl. No.: 561,390

[22] Filed: Nov. 21, 1995

Related U.S. Application Data

[63] Continuation of Ser. No. 278,141, Jul. 21, 1994, abandoned.

[30] Foreign Application Priority Data

Jul. 27, 1993 [JP] Japan ..... 5-203757
Feb. 24, 1994 [JP] Japan ..... 6-53329

[51] Int. Cl.[6] ..... D04H 1/44; D04H 3/04

[52] U.S. Cl. ..... 428/113; 428/131; 428/213; 442/50; 442/334; 442/352; 442/408

[58] Field of Search ..... 428/113, 131, 428/213; 442/50, 334, 352, 408

[56] References Cited

U.S. PATENT DOCUMENTS

| | | | |
|---|---|---|---|
| 3,485,706 | 12/1969 | Evans | 428/113 |
| 3,679,536 | 7/1972 | Kalwaites . | |
| 3,681,183 | 8/1972 | Kalwaites | 428/113 |
| 3,681,184 | 8/1972 | Kalwaites | 428/113 |
| 4,297,404 | 10/1981 | Nguyen | 428/85 |
| 4,514,455 | 4/1985 | Hwang . | |
| 4,555,430 | 11/1985 | Mays . | |
| 4,623,575 | 11/1986 | Brooks et al. | 428/113 |
| 4,734,311 | 3/1988 | Sokolowski . | |
| 4,960,630 | 10/1990 | Greenway et al. . | |
| 5,013,309 | 5/1991 | Baigas, Jr. et al. . | |
| 5,369,858 | 12/1994 | Gilmore et al. | 28/104 |

FOREIGN PATENT DOCUMENTS

| | | |
|---|---|---|
| 0 423 619 | 4/1991 | European Pat. Off. . |
| 26 25 836 | 12/1977 | Germany . |
| 49-20823 | 2/1974 | Japan . |
| 49-20823 | 5/1974 | Japan . |
| 54-6664 | 3/1979 | Japan . |
| 04 136 295 | 5/1992 | Japan . |

*Primary Examiner*—Kathleen Choi
*Attorney, Agent, or Firm*—Oliff & Berridge, P.L.C.

[57] ABSTRACT

A non-woven fabric in which large fiber bundles of the fabric intersect one another, small fiber bundles thereof intersect one another among said large fiber bundles, and the fibers of the fiber bundles are being entangled with one another among the large fiber bundles, among the small fiber bundles and at the intersecting points of the fiber bundles, may be manufactured by fluid-entangling fiber webs on a support member having large pores to obtain said large fiber bundles therein; and further fluid-entangling fiber webs of the resultant intermediate on a support member having small pores from either the same direction or the opposite direction to form said small fiber bundles therein. The non-woven fabric has excellent draping property, covering property and abrasion resistance and can be used as an interlining, as a base material for synthetic leathers, as a variety of base materials, as an interior material, as a simple garment, as a medical gown, etc.

25 Claims, 1 Drawing Sheet

NON-WOVEN FABRIC

This is a Continuation of application Ser. No. 08/278,141 filed Jul. 21, 1994, now abandoned.

FIELD OF THE INVENTION

The present invention relates to a non-woven fabric that has excellent draping property, covering property and abrasion resistance and can be used as an interlining, as a base material for synthetic leathers, as a variety of base materials, as an interior material, as a simple garment, as a medical gown, etc., and to a method of producing the same.

BACKGROUND OF THE INVENTION

An existing non-woven fabric having softness and, particularly, excellent shearing property, good covering property and high strength, can be represented by a patterned non-woven fabric prepared by a fluid-entangling method disclosed in Japanese Patent Publication No. 20823/1974. This non-woven fabric is constituted by a first section comprising a number of entangled fibers 5, a second section comprising a group of fibers 6 coupling the first section, and a third section 4 where there exists either no fiber or a fiber at a low density (see FIG. 2).

When the third section, where no fiber exists, is large, the non-woven fabric acquires a structure with large pores and exhibits excellent softness accompanied, however, by poor covering property. When the third section is small, the non-woven fabric exhibits excellent covering property but lacks softness and, particularly, shearing property.

Japanese Patent Publication No. 6664/1979 discloses a non-woven fabric (see FIG. 3) of the structure of a woven texture in which fibers 9 and 10 are converged to form double layers 7 and 8 by entangling the fibers using a water stream from a nozzle of a porous diameter of 0.3 mm on a support member of 10 meshes or smaller. The fibers are then entangled on a support member of 18 meshes or smaller. The fibers are entangled between covering screens in both processes. This non-woven fabric forming the two layers 7 and 8, however, tends to become bulky or contains many voids when its weight is small.

Clothing uses a variety of interlinings to utilize properties of a surface material and to reinforce weak points of the surface material. One of the examples can be represented by a non-woven interlining obtained by partly bonding the fiber webs by the application of heat and pressure without, however, exhibiting the draping property to a sufficient degree. Additionally, because of its poor extension recovering property, the non-woven fabric fails to follow the movement of the body. When the fiber webs are produced at an increased production rate, furthermore, the fibers tend to be oriented in the longitudinal direction (direction in which the fiber webs flow), whereby the tensile strength is lost in the transverse direction (direction at right angles with the direction in which the fiber webs flow), plastic deformation takes place, and the function of the interlining is lost.

SUMMARY OF THE INVENTION

An object of the present invention is to provide a non-woven fabric that is free from the above-mentioned defects inherent in the prior non-woven fabrics, i.e., that has softness and, particularly, shearing property comparable to that of the fluid-entangled non-woven fabric having large pores yet maintaining strength, and further has covering property comparable to that of the fluid-entangled non-woven fabric having small pores. A further object of the present invention is to provide an interlining having excellent draping property and extension recovering property and that permits slight plastic deformation.

In order to obtain a non-woven fabric having the above-mentioned properties, the present inventors have conducted keen study and have produced a non-woven fabric in which, as shown in FIG. 1, large fiber bundles 1 intersect one another, small fiber bundles 2 intersect one another among the large fiber bundles, and the fibers 3 of the fiber bundles are entangled with one another among the large fiber bundles, among the small fiber bundles and at the intersecting points of the fiber bundles. The present inventors have also developed a method of producing the above non-woven fabric.

The present invention relates to a non-woven fabric and an interlining in which large fiber bundles intersect one another, small fiber bundles intersect one another among the large fiber bundles, and the fibers of the fiber bundles are entangled with one another among the large fiber bundles, among the small fiber bundles and at the intersecting points of the fiber bundles.

The present invention relates to a non-woven fabric and an interlining in which small fiber bundles or fibers are branched from the fiber bundles and are partly and irregularly oriented and are entangled.

The present invention relates to a non-woven fabric and an interlining in which fibers of the web by the wet-laid method are entangled, and which contains very fine fibers obtained by rendering splittable fibers to become more fine, contains fibers obtained by fibrillating the cellulose fibers prepared by a solvent extraction method, contains latently crimped fibers, or contains heat-shrinkable fibers.

The present invention relates to a non-woven fabric and an interlining having a thermal bonding resin that is adhered to one surface or both surfaces thereof.

The present invention further relates to a method of producing a non-woven fabric, wherein fiber webs of the starting non-woven fabric are fluid-entangled on a support member having large pores to obtain large fiber bundles therein that are intersecting, and the resultant fiber webs are further fluid-entangled from the same direction or from the opposite direction on a support member having small pores to form small fiber bundles in the non-woven fabric.

The invention relates to a method of producing a non-woven fabric, wherein fluid-entangled non-woven fabric is fluid-entangled on a support member having large pores to obtain large fiber bundles therein that are intersecting, and the fluid-entangled non-woven fabric is further fluid-entangled from the same direction or from the opposite direction on a support member having small pores to form small fiber bundles in the non-woven fabric.

The invention relates to a method of producing a non-woven fabric, wherein fluid-entangled non-woven fabric is fluid-entangled on a support member having large pores to obtain large fiber bundles therein that are intersecting, and the fluid-entangled non-woven fabric is further fluid-entangled from the opposite direction on a support member having small pores to form small fiber bundles in the non-woven fabric.

The invention relates to a method of producing a non-woven fabric wherein the support member of a first stage has from about 12 to about 60 meshes and the support member of a second stage has from about 20 to about 150 meshes. In a preferred embodiment, the invention relates to a method of producing a non-woven fabric wherein the support member of a first stage has from about 12 to about 30 meshes and the support member of a second stage has from about 20 to about 70 meshes.

The invention relates to a method of producing a non-woven fabric wherein the nozzle has a porous diameter of from about 0.05 to about 0.3 mm, and more preferably a porous diameter of from about 0.075 to about 0.25 mm.

The invention relates to a method of producing a non-woven fabric wherein the water pressure in the nozzle of a first stage is from about 20 to about 150 kg/cm$^2$ and the water pressure in the nozzle of a second stage is from about 30 to about 200 kg/cm$^2$. In a preferred embodiment, the invention relates to a method of producing a non-woven fabric wherein the water pressure in the nozzle of a first stage is from about 20 to about 100 kg/cm$^2$ and the water pressure in the nozzle of a second stage is from about 40 to about 150 kg/cm$^2$.

The present invention relates to a method of producing a non-woven fabric wherein webs of the starting non-woven fabric are fluid-entangled on a support member having large pores to obtain large fiber bundles therein that are intersecting, the webs are further fluid-entangled from the same direction on a support member having small pores to obtain small fiber bundles in the non-woven fabric, and the fiber bundles are expanded in the transverse direction and are heat-treated.

The present invention relates to a method of producing a non-woven fabric wherein webs of the starting non-woven fabric are fluid-entangled on a support member having large pores to obtain large fiber bundles therein that are intersecting, the webs are further fluid-entangled from the opposite direction on a support member having small pores to obtain small fiber bundles in the non-woven fabric, and the fiber bundles are expanded in the transverse direction and are heat-treated.

DETAILED DESCRIPTION OF PREFERRED EMBODIMENTS

Figure 1:
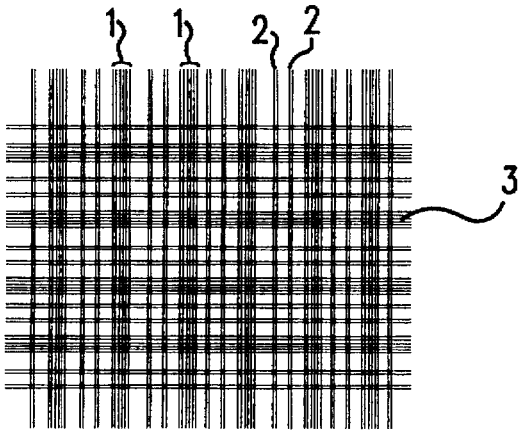
FIG. 1 is a plan view illustrating a non-woven fabric of the present invention.
Figure 2:
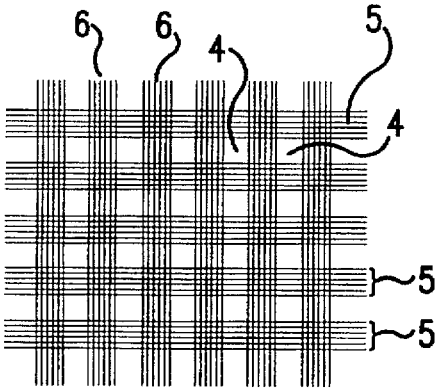
FIG.2 PRIOR ART
FIG. 2 is a plan view illustrating a conventional non-woven fabric.
Figure 3:
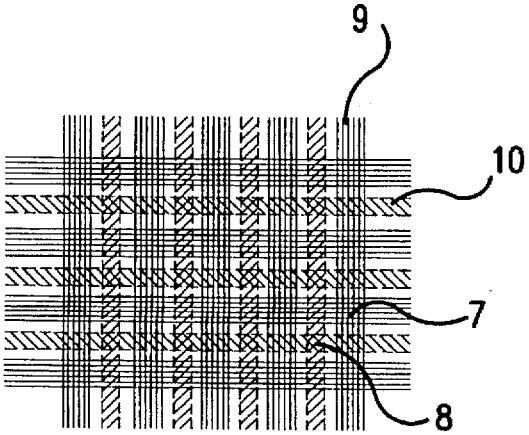
FIG.3 PRIOR ART
FIG. 3 is a plan view illustrating a conventional non-woven fabric.

The present invention will now be described in more detail. The non-woven fabric of the present invention has a structure in which relatively large fiber bundles intersect regularly or irregularly in the longitudinal direction, transverse direction, like a lattice or in biasing directions at any angle. Relatively small fiber bundles are formed in parallel among the large fiber bundles in the longitudinal direction, transverse direction or in biasing directions. Additionally, the fibers are entangled among the large fiber bundles, among the small fiber bundles and at intersecting points of the large and small fiber bundles. The non-woven fabric of the present invention has usually from about 10 to 80 large fiber bundles per inch, preferably from about 12 to 60 large fiber bundles per inch, and more preferably from about 15 to 30 large fiber bundles per inch. The non-woven fabric of the present invention has usually from about 15 to 200 small fiber bundles per inch, preferably from about 20 to 150 small fiber bundles per inch, and more preferably from about 25 to 100 small fiber bundles per inch. A diameter of said large fiber bundle ranges from about 0.1 to about 4.0 mm, and preferably from about 0.2 to about 2.2 mm. A diameter of said small fiber bundle ranges from about 0.01 to about 2.5 mm, and preferably from about 0.04 to about 1.3 mm.

Here, the longitudinal direction stands for a direction in which the webs travel when the webs are to be fluid-entangled, and the transverse direction stands for a direction of width at right angles therewith.

As a fiber, there can be used any suitable fiber, including but not limited to a natural fiber such as cotton or wool, a regenerated fiber such as rayon, etc., or a synthetic fiber such as polyester, nylon, polyolefin, vinylon or aramid. There can be further used splittable fibers, shrinkable fibers, latently crimped fibers and thermal bonding fibers. It is preferred to use splittable fibers, shrinkable fibers and latently crimped fibers since they tend to be strongly entangled and give favorable durability and abrasion resistance. These fibers may be used alone or in a combination of two or more.

The splittable fiber should be the one that is mechanically split through the entangling processing using a water stream or the like, and turns into fine fibers. Desirably, the splittable fiber comprises two or more kinds of resins, as exemplified by a fiber having the shape of chrysanthemum petals in cross section, a laminated fiber or the like. The non-woven fabric obtained by splitting and entangling the splittable fiber has a structure in which fine fibers are entangled to a high degree.

Examples include a chrysanthemum-type fiber having a cross-sectional shape in which a fiber component is disposed among other fiber components, and a laminated fiber having a cross-sectional shape in which different fiber components are alternatingly laminated like layers. Combinations of these resins include a polyamide resin and a polyester resin, a polyamide resin and a polyolefin resin, a polyamide resin and a polyacrylonitrile copolymer resin, a polyester resin and a polyolefin resin, a polyolefin resin and a polyacrylonitrile resin, a polyester resin and a polyacrylonitrile resin, and the like.

The non-woven fabric that contains very fine fibers obtained by mechanically splitting the splittable fiber in an amount of about 20% by weight or more exhibits excellent draping property and extension recovering property, permits only slight plastic deformation to take place, and is suitable for use as an interlining. The non-woven fabric (and interlining) containing a fiber (hereinafter referred to as fibrillated fiber) obtained by fibrillating the cellulose fiber that is prepared by the solvent extraction method has excellent repellent force and is also suitable for use as an interlining.

When the non-woven fabric has a weight of from about 15 to about 45 g/m$^2$ there still exists versatility among the fiber bundles to exhibit excellent draping property. Furthermore, since the fiber bundles are entangled at the intersecting points, the non-woven fabric exhibits excellent extension recovering property and slight plastic deformation, and is suitable for use as an interlining.

When the finely fibrillated fiber is contained in an amount of about 20% by weight or more in the fibers constituting the non-woven fabric, there will be obtained an interlining having increased strength and draping property. More preferably, the very fine fiber should be contained in an amount of about 30% by weight or larger and, most preferably, the very fine fiber should be contained in an amount of about 40% by weight or larger.

Moreover, the cellulose fiber obtained by the solvent extraction method is not completely split, unlike the splittable fiber, but part of the fiber surfaces can be mechanically fibrillated, making it possible to obtain a non-woven fabric having excellent strength. By utilizing the repelling property of the fibrillated fiber, furthermore, there is obtained a non-woven fabric having excellent repelling property.

The cellulose fiber obtained by the solvent extraction method can be fibrillated by the stream of a fluid, such as a water stream, similar to the splittable fiber.

In order to impart repelling property to the interlining, the fibrillated fiber should be contained in the fibers constituting the non-woven fabric in an amount of about 10% by weight or larger and, more preferably, in an amount of about 20% by weight or larger.

When the amount of the fibrillated fiber in the fibers constituting the non-woven fabric exceeds about 90% by weight, the draping property may be deteriorated. Therefore, the amount of the fibrillating fiber should be about 90% by weight or smaller and, more preferably, about 80% by weight or smaller.

The latently crimped fiber may be composed of a resin such as polyester, polyamide or polyolefin, and may be a composite fiber such as of the sheath-core type or the junction type. The non-woven fabric obtained by entangling the latently crimped fiber has a structure in which the fibers are bulkily entangled, and exhibits excellent elasticity and heat insulating property.

The shrinkable fiber may be composed of a resin such as polyester or polyolefin, and shrinks upon heat treatment. The non-woven fabric obtained by entangling the shrinkable fiber has a structure in which the fibers are entangled to a high degree through the heat treatment, and exhibits excellent abrasion resistance.

It is desired that the fiber is a cut fiber or a staple fiber having a fineness of from about 0.01 to about 5 deniers and a length of about 3 mm or longer.

When the fineness is larger than about 0.01 deniers, the fiber exhibits strength which is large enough that the non-woven fabric may be used as an interlining. Furthermore, when the fineness is not larger than about 5 deniers, the draping property is not lost. When the fiber length is about 3 mm or longer, the fibers are entangled by each other and do not develop plastic deformation.

The fiber webs may be formed by either the dry method or the wet method, or a combination thereof. The dry method makes it possible to obtain unidirectional webs, cross-layer webs, random webs or a combination thereof, enabling the fiber bundles to be easily formed.

In fluid-entangling the fiber webs, the fiber webs of different compositions may be laminated into two layers or three layers.

According to the present invention as described above, it is possible to use fiber webs that are obtained by suitably combining the methods of forming the fiber webs, methods of orienting the fibers and fiber webs of different constitutions.

According to the present invention, the fluid-entangled non-woven fabric is obtained by, first, placing the fiber webs on a support member having large pores and executing a first stage of entangling with a high-speed columnar stream to obtain a porous sheet. The porous sheet is then placed on a support member having pores smaller than the pores of the support member in the first stage, and a second stage of entangling is executed with a high-speed columnar stream to obtain a non-woven fabric having a desired structure.

The porous sheet obtained by the first stage of fluid-entangling makes it possible to obtain relatively thick fiber bundles that are intersecting maintaining a relatively long distance. The thick fiber bundles are partly split through the second stage of fluid-entangling, whereby fiber bundles having various finenesses are formed. When the fiber bundles that are intersecting maintaining a relatively long distance are subjected to the second stage of fluid-entangling, the linear fiber bundles are entangled by each other. Therefore, the non-woven fabric of the present invention exhibits a particular appearance in which the fiber bundles are joined together lengthwisely. This structure and appearance is altogether different from the non-woven fabric having regular pores in which fiber bundles are intersecting maintaining a relatively short distance obtained by the processing on a support member having small pores only, or the non-woven fabric having double layers and pores obtained by the processing on a support member having dissimilar pores.

It is desired that the fluid-entangling is carried out by primarily using water. The nozzle should be such that the orifices have a porous diameter of from about 0.05 to about 0.3 mm and, preferably, from about 0.10 to about 0.25 mm. The orifices should be linearly arranged, arranged in two or three rows, or arranged in a zig-zag manner maintaining a pitch of from about 0.2 to about 3 mm. The water pressure at the nozzle should be from about 10 to about 300 $kg/cm^2$ and, particularly, from about 20 to about 150 $kg/cm^2$. The number of the nozzles should be one or more, and the water pressure should be gradually increased. In the first stage of processing, the amount of striking energy of water per unit area of the web should be smaller than that in the second stage of processing. This can be accomplished by decreasing the number of nozzles, decreasing the diameter of the orifices, or decreasing the injection pressure of the fluid.

The water pressure at the nozzle may be the same or different in each of the stages. In the first stage, in particular, the nozzle pressure is preferably different.

The support member having large pores in the first stage is a net or a porous plate made of a metal or a plastic material. In the case of the net, it should be a plain-woven coarse net of from about 12 to about 30 meshes. However, a net obtained by a method other than the plain-weaving may be used, as a matter of course. In the case of the porous plate, the distance among the pores should be about 0.4 mm or larger. The support member having small pores in the second stage is also a net or a porous plate, which is made of a metal or a plastic material. In the case of the net, the mesh should be finer than that of the support member in the first stage. Desirably, the mesh should be finer by from about 1.3 to about 5 times than the mesh in the first stage. In the case of the porous plate, the distance among the pores should be from about 0.2 to about 0.8 times that of the first stage.

After the entangling with fluid, the non-woven fabric is expanded in the transverse direction by from about 3 to about 30% and is then thermally set using a drier or the like. The non-woven fabric is then fixed in a state in which the entangled fibers are stretched to some extent, exhibiting an increased strength in the transverse direction, i.e., a decreased difference in the strength from the longitudinal direction and, hence, developing slight plastic deformation.

When the non-woven fabric is thermally set using a drier or the like after being fixed and expanded in the transverse direction, there will take place plastic deformation when the non-woven fabric is simply expanded in the transverse direction unless the non-woven fabric obtained through the entangling processing has great strength to some extent. When the fibers constituting the non-woven fabric contain very fine fibers obtained by mechanically splitting splittable fibers or fibrillated fibers, the non-woven fabric exhibits large strength and undergoes little plastic deformation even when it is expanded since the fibers are entangled to a high degree.

The thus obtained non-woven fabric may be impregnated with a thermal bonding resin, or the thermal bonding resin may be adhered to one or both surfaces of the non-woven fabric. The non-woven fabric impregnated with, or adhered with, the thermal bonding resin has a merit in that it prevents fibers from escaping.

Examples of the thermal bonding resin include low-melting resins such as polyethylene, polyamide, polyvinyl chloride and polyester. The thermal bonding resin may be adhered either regularly like dots or irregularly, and there is no particular limitation.

The non-woven fabric having a thermal bonding resin is used as an interlining for adhesion.

According to the present invention, the processing such as fluid-entangling or needle punching may be carried out in advance prior to carrying out the entangling processing in the first stage in order that the fibers that are formed are more strongly entangled in the inside or that the fiber webs can be handled easily.

In the needle punching, any commercially available needle may be employed. Specific needles for any particular non-woven fabric will be employed depending upon a variety of factors including the fineness of fiber, the thickness of fabric, appearance and smoothness of products, etc. Usually from about 5 to about 50 needles are preferably used per $cm^2$ of the non-woven fabric.

The pre-treatment in the first stage should comprise placing a fiber web on the support member having small pores, entangling it with a high-speed columnar stream to prepare a sheet without pores, and subjecting the sheet to the entangling treatment in the first stage and to the entangling treatment in the second stage.

The fluid-entangling in the pre-stage is carried out using a net or a porous plate made of a metal or a plastic material. In the case of the net, the mesh should be as fine as about 60 meshes or finer and the wire fineness should be large to obtain favorable converging property. In order to orient the fiber bundles in the longitudinal and transverse directions, it is desired to use a plain-woven net. In the case of the porous plate, the distance among the pores should not be larger than about 0.4 mm. There is no particular limitation on the surface that the columnar stream hits.

The present invention will be more concretely described below by way of Examples, to which, however, the invention is in no way limited.

EXAMPLE 1

A rayon fiber having a fineness of 1.5 deniers and a cut length of 38 mm was carded and was then cross-wrapped to prepare a cross-layer web of 90 $g/m^2$.

The web was placed on a conveyer of a plain-woven net of 15 meshes of polyester filaments having a filament diameter of 0.7 mm, and a columnar water stream of a first stage was injected onto the web from two nozzles each having a row of orifices of a porous diameter of 0.15 mm maintaining a pitch of 0.8 mm disposed over the conveyer while moving the conveyer at a speed of 15 meters per minute. The water pressure in the nozzle heads in the first stage was 40 $kg/cm^2$ in the first nozzle and 70 $kg/cm^2$ in the second nozzle. There was obtained a porous sheet having pores maintaining a distance of 15 meshes.

Next, the sheet was placed on a conveyer of a plain-woven net of 25 meshes of polyester filaments having a filament diameter of 0.4 mm, so that the columnar water stream hit the same surface as the surface in the first stage. While moving the conveyer at a speed of 15 meters per minute, a second stage columnar water stream having a pressure of 90 $kg/cm^2$ was injected from two nozzles having the same shape as that of the first stage. The thus obtained non-woven fabric possessed a weight of 83 $g/m^2$, a thickness of 0.65 mm, a tensile strength of 8.0 kg/5 cm width in average in the longitudinal direction and in the transverse direction, a tensile elongation of 44% and a shearing stiffness of 3.1 gf/cm.

The non-woven fabric possessed a structure in which a maximum of 15 large fiber bundles intersected per inch, 25 small fiber bundles intersected among the large fiber bundles, and fibers of the fiber bundles entangled among the large fiber bundles, among the small fiber bundles and at intersecting points of the fiber bundles. The non-woven fabric exhibited excellent draping property and possessed a structure in which fiber bundles entered into the pores formed in the first stage creating a closed texture and exhibiting excellent covering property.

COMPARATIVE EXAMPLE 1

The water stream-entanglement was carried out in the same manner as in Example 1 in the first stage, however omitting the second stage. The thus obtained non-woven fabric possessed a weight of 84 $g/m^2$, a thickness of 0.65 mm, a tensile strength of 8.5 kg/5 cm width in average in the longitudinal direction and in the transverse direction, a tensile elongation of 45% and a shearing stiffness of 3.3 gf/cm. The non-woven fabric possessed the shearing stiffness comparable to that of Example 1 and was excellent in softness but possessed large pores and was inferior in covering property to Example 1.

COMPARATIVE EXAMPLE 2

The water stream-entanglement was carried out in the same manner as in Example 1 in the second stage, however omitting the first stage.

The thus obtained non-woven fabric possessed a weight of 86 $g/m^2$, a thickness of 0.67 mm, a tensile strength of 8.0 kg/5 cm width in average in the longitudinal direction and in the transverse direction, a tensile elongation of 46% and a shearing stiffness of 3.7 gf/cm. The non-woven fabric possessed covering property comparable to that of Example 1 and was excellent in softness but possessed large shearing stiffness and was inferior in softness to Example 1.

EXAMPLE 2

Thirty percent of a polyester fiber having a fineness of 1.5 deniers and a cut length of 38 mm and 70% of a polyester/nylon splittable fiber (trade name Belima, Type BSS, produced by Kanebo Co., Japan) having a fineness of 2 deniers and a cut length of 38 mm were cotton-mixed, carded, and were cross-wrapped to prepare a cross-layer web of 80 $g/m^2$.

The web was placed on a conveyer of a plain-woven net of 25 meshes of polyester filaments having a filament diameter of 0.4 mm, and a columnar water stream of a first stage was injected onto the web from two nozzles each having a row of orifices of a porous diameter of 0.15 mm maintaining a pitch of 0.8 mm disposed over the conveyer while moving the conveyer at a speed of 15 meters per minute. The water pressure in the nozzle heads in the first stage was 50 kg/cm$^2$ in the first nozzle and 100 kg/cm$^2$ in the second nozzle. There was obtained a porous sheet having pores of 25 meshes.

Next, the sheet was placed on a conveyer of a plain-woven net of bronze of 50 meshes having a wire diameter of 0.3 mm, so that the columnar water stream hit the same surface as the surface in the first stage. While moving the conveyer at a speed of 15 meters per minute, a columnar water stream of a second stage of a pressure of 120 kg/cm$^2$ was injected from two nozzles having the same shape as that of the first stage. The thus obtained non-woven fabric possessed a weight of 73 g/m$^2$, a thickness of 0.54 mm, a tensile strength of 19 kg/5 cm width in average in the longitudinal direction and in the transverse direction, a tensile elongation of 78% and a shearing stiffness of 3.1 gf/cm.

The non-woven fabric possessed a structure in which a maximum of 25 large fiber bundles intersected per inch, 50 small fiber bundles intersected among the large fiber bundles, and fibers of the fiber bundles entangled among the large fiber bundles, among the small fiber bundles and at intersecting points of the fiber bundles. The non-woven fabric exhibited excellent draping property and possessed a structure in which fiber bundles entered into the pores formed in the first stage creating a closed texture and exhibiting excellent covering property.

COMPARATIVE EXAMPLE 3

The water stream-entanglement was carried out in the same manner as in Example 2 in the second stage, however omitting the first stage.

The thus obtained non-woven fabric possessed a weight of 75 g/m$^2$, a thickness of 0.48 mm, a tensile strength of 21 kg/5 cm width in average in the longitudinal direction and in the transverse direction, a tensile elongation of 72% and a shearing stiffness of 4.7 gf/cm. The non-woven fabric possessed covering property superior to that of Example 1 but possessed large shearing stiffness and was inferior in softness to Example 2.

EXAMPLE 3

A unidirectional web of 15 g/m$^2$ was prepared from a polyester fiber having a fineness of 1.5 deniers and a cut length of 38 mm. Next, the same polyester fiber was cross-wrapped to prepare a cross-layer web of 60 g/m$^2$ which was then laminated on the unidirectional web to prepare a web of a total of 75 g/m$^2$.

Then, as a pre-treatment, the web was placed on a conveyer of a plain-woven net of bronze of 80 meshes having a wire diameter of 0.16 mm, and a columnar water stream was injected from a nozzle having a row of orifices of a porous diameter of 0.15 mm maintaining a pitch of 1.0 mm disposed over the conveyer while moving the conveyer at a speed of 15 meters per minute. The water pressure in the nozzle head in the pre-treatment was 30 kg/cm$^2$. There was obtained a sheet without pores.

The sheet was placed on a conveyer of a plain-woven net of 15 meshes of polyester filaments having a filament diameter of 0.7 mm, and a columnar water stream of a first stage was injected onto the web from two nozzles each having a row of orifices of a porous diameter of 0.15 mm maintaining a pitch of 1.0 mm disposed over the conveyer while moving the conveyer at a speed of 15 meters per minute. The water pressure in the nozzle heads in the first stage was 30 kg/cm$^2$ in the first nozzle and 70 kg/cm$^2$ in the second nozzle. There was obtained a porous sheet having pores of 15 meshes.

Next, the sheet was placed on a conveyer of a plain-woven net of polyester filaments of 25 meshes having a filament diameter of 0.4 mm, so that the columnar water stream hit the surface opposite to the surface of the first stage. While moving the conveyer at a speed of 15 meters per minute, a columnar water stream of a second stage was injected from two nozzles each having a row of orifices of a porous diameter of 0.15 mm maintaining a pitch of 1.0 mm disposed over the conveyer. The water pressure in the nozzle heads in the second stage was 90 kg/cm$^2$ in these two nozzles.

The thus obtained non-woven fabric possessed a weight of 68 g/m$^2$, a thickness of 0.72 mm, a tensile strength of 18 kg/5 cm width in average in the longitudinal direction and in the transverse direction, a tensile elongation of 70% and a shearing stiffness of 2.1 gf/cm.

The non-woven fabric possessed a structure in which a maximum of 15 large fiber bundles intersected per inch, 25 small fiber bundles intersected among the large fiber bundles, and fibers of the fiber bundles entangled among the large fiber bundles, among the small fiber bundles and at intersecting points of the fiber bundles. The non-woven fabric exhibited excellent draping property and possessed a structure in which fiber bundles entered into the pores formed in the first stage creating a closed texture and exhibiting excellent covering property.

COMPARATIVE EXAMPLE 4

The water stream-entanglement was carried out in the same manner as in Example 3 in the second stage, however omitting the first stage.

The thus obtained non-woven fabric possessed a weight of 65 g/m$^2$, a thickness of 0.71 mm, a tensile strength of 17 kg/5 cm width in average in the longitudinal direction and in the transverse direction, a tensile elongation of 80% and a shearing stiffness of 2.5 gf/cm. The non-woven fabric possessed covering property superior to that of Example 3 but possessed large shearing stiffness and was inferior in softness to Example 3.

EXAMPLE 4

Fifty percent of a polyester fiber having a fineness of 1.0 denier and a cut length of 38 mm and 50% of a polyester/nylon splittable fiber (trade name Belima, Type BSS, produced by Kanebo Co., Japan) having a fineness of 2 deniers and a cut length of 51 mm were cotton-mixed to prepare a cross-layer web of 11 g/m$^2$, which was then laminated on the unidirectional web to prepare a web of a total of 36 g/m$^2$.

Then, as a pre-treatment, the web was placed on a conveyer of a plain-woven net of 100 meshes, and a columnar water stream was injected onto the web from a nozzle having a row of orifices of a porous diameter of 0.13 mm maintaining a pitch of 0.6 mm disposed over the conveyer. The water pressure in the nozzle head in the pre-treatment was 20 kg/cm$^2$. There was obtained a sheet without pores.

The sheet was placed on a conveyer of a plain-woven net of 25 meshes, and a columnar water stream of a first stage was injected onto the web from two nozzles each having a row of orifices of a porous diameter of 0.13 mm maintaining a pitch of 0.6 mm disposed over the conveyer. The water pressure in the nozzle heads in the first stage was 30 kg/cm$^2$ in the first nozzle and 60 kg/cm$^2$ in the second nozzle. There was obtained a porous sheet having pores of 25 meshes.

Next, the sheet was placed on a conveyer of a plain-woven net of 50 meshes, so that the columnar water stream hit the surface opposite to the surface of the first stage. A columnar water stream of a second stage was injected from two nozzles each having a row of orifices of a porous diameter of 0.13 mm maintaining a pitch of 0.6 mm. The water pressure in the nozzle heads in the second stage was 70 kg/cm$^2$ in these two nozzles.

The thus obtained non-woven fabric possessed a weight of 32 g/m$^2$, a thickness of 0.31 mm, a tensile strength of 8.8 kg/5 cm width in average in the longitudinal direction and in the transverse direction, a tensile elongation of 105% and a shearing stiffness of 1.8 gf/cm.

The non-woven fabric possessed a structure in which a maximum of 25 large fiber bundles intersected per inch, 50 small fiber bundles intersected among the large fiber bundles, and fibers of the fiber bundles entangled among the large fiber bundles, among the small fiber bundles and at intersecting points of the fiber bundles. The non-woven fabric exhibited excellent draping property and possessed a structure in which fiber bundles entered into the pores formed in the first stage creating a closed texture, exhibiting excellent covering property and being suited for use as an interlining.

EXAMPLE 5

A non-woven fabric was prepared in the same manner as in Example 4 except for using 50% of a cellulose fiber (produced by Courtaulds Ltd.) having a fineness of 1.5 deniers and a cut length of 38 mm obtained by the solvent extraction method instead of using the polyester fiber used in Example 4.

The thus obtained non-woven fabric possessed a weight of 32 g/m$^2$, a thickness of 0.30 mm, a tensile strength of 9.2 kg/5 cm width in average in the longitudinal direction and in the transverse direction, a tensile elongation of 50% and a shearing stiffness of 2.3 gf/cm.

The non-woven fabric possessed a structure in which a maximum of 25 large fiber bundles intersected per inch, 50 small fiber bundles intersected among the large fiber bundles, and fibers of the fiber bundles entangled among the large fiber bundles, among the small fiber bundles and at intersecting points of the fiber bundles. The non-woven fabric exhibited excellent draping property and possessed a structure in which fiber bundles entered into the pores formed in the first stage creating a closed texture, exhibiting excellent covering property and being suited for use as an interlining.

EXAMPLE 6

A unidirectional web of 15 g/m$^2$ was prepared using a latently crimped polyester fiber having a fineness of 1.5 denier and a cut length of 51 mm and exhibiting crimping property at 190° C. Next, the same fiber was cross-wrapped to prepare a cross-layer web of 60 g/m$^2$ which was then laminated on the unidirectional web to prepare a web of a total of 75 g/m$^2$.

Then, the pre-treatment and the water stream entanglement of the first stage and the second stage were carried out in the same manner as in Example 3.

The thus obtained non-woven fabric was subjected to contraction using a tentering machine at a temperature of 200° C. Here, in order that the non-woven fabric exhibits crimping property to a sufficient degree, the tentering was carried out under the conditions of an overfeed of 10% and a width shrinkage rate of 10%.

The non-woven fabric after the tentering possessed a weight of 85 g/m$^2$, a thickness of 0.52 mm, a tensile strength of 12.6 kg/5 cm width in average in the longitudinal direction and in the transverse direction, and a tensile elongation of 90%. The non-woven fabric exhibited excellent abrasion resistance, i.e., exhibited excellent anti-peeling property of Level 5 in a test conducted by using an ICI-type tester in compliance with the method A under JIS (Japanese Industrial Standards) L1076.

The non-woven fabric possessed a structure in which a maximum of 17 large fiber bundles intersected per inch, 28 small fiber bundles intersected among the large fiber bundles, and fibers of the fiber bundles entangled among the large fiber bundles, among the small fiber bundles and at intersecting points of the fiber bundles. The non-woven fabric exhibited excellent draping property and possessed a structure in which fiber bundles entered into the pores formed in the first stage creating a closed texture and exhibiting excellent covering property.

EXAMPLE 7

Fifty percent of a heat-shrinking polyester fiber having a fineness of 1.5 deniers and a cut length of 38 mm and that thermally contracts at 90° C. or higher and 50% of a polyester/nylon splittable fiber (trade name Belima, Type BSS, produced by Kanebo Co., Japan) having a fineness of 2 deniers and a cut length of 51 mm were cotton-mixed to prepare a unidirectional web of 15 g/m$^2$. Next, the fiber of the same blend was cross-wrapped to prepare a cross-layer web of 70 g/m$^2$, which was then laminated on the unidirectional web to prepare a web of a total of 85 g/m$^2$.

Then, the pre-treatment and the water stream entanglement of the first stage and the second stage were carried out in the same manner as in Example 3.

The thus obtained non-woven fabric was contracted using a tentering machine at a temperature of 150° C. Here, the tentering was carried out under the conditions of an overfeed of 10% and a width shrinkage rate of 10%.

The non-woven fabric after the tentering possessed a weight of 95 g/m$^2$, a thickness of 0.57 mm, a tensile strength of 22 kg/5 cm width in average in the longitudinal direction and in the transverse direction, and a tensile elongation of 78%. The non-woven fabric exhibited excellent abrasion resistance, i.e., exhibited excellent anti-peeling property of Level 5 in a test conducted by using an ICI-type tester in compliance with the method A under JIS L1076.

The non-woven fabric possessed a structure in which a maximum of 17 large fiber bundles intersected per inch, 28 small fiber bundles intersected among the large fiber bundles, and fibers of the fiber bundles entangled among the large fiber bundles, among the small fiber bundles and at intersecting points of the fiber bundles. The non-woven fabric exhibited excellent draping property and possessed a structure in which fiber bundles entered into the pores formed in the first stage creating a closed texture and exhibiting excellent covering property.

EXAMPLE 8

A polyester fiber having a fineness of 0.1 deniers and a cut length of 5 mm was dispersed in a viscous aqueous solution containing a thickener, for example, sodium polyacrylate, polyethylene oxide, or the like (conventionally termed white water, i.e. "Haku-sui" in Japanese), a sheet web of 80 g/m$^2$ was prepared on a conveyer of a plain-woven net of 100 mesh using a sheet-making machine. Then, as the pre-treatment, a columnar water stream was injected onto the web from a nozzle having a row of orifices of a porous diameter of 0.15 mm maintaining a pitch of 0.8 mm disposed over the conveyer while moving the conveyer. In this case, the hydraulic pressure in the nozzle head was 40 kg/cm$^2$. There was obtained a sheet having shape-retaining property but without pores.

The sheet was subjected to the water-stream-entanglement in the same manner as in Example 2. The thus obtained non-woven fabric possessed a weight of 72 g/m$^2$, a thickness of 0.42 mm, a tensile strength of 4.5 kg/5 cm width in average in the longitudinal direction and in the transverse direction, a tensile elongation of 65% and a shearing stiffness of 3.0 gf/cm.

The non-woven fabric possessed the same structure as that of Example 2, and exhibited excellent draping property and covering property.

EXAMPLE 9

A cross-layer web of 55 g/m$^2$ was prepared from a polyester fiber having a fineness of 1.5 deniers and a cut length of 38 mm.

Then, as the pre-treatment, the web was placed on a conveyer of a plain-woven net of a bronze of 80 mesh having a wire diameter of 0.16 mm, and a columnar water stream was injected onto the web from a nozzle having a row of orifices of a porous diameter of 0.15 mm maintaining a pitch of 0.8 mm disposed over the conveyer while moving the conveyer at a speed of 15 meters per minute. The water pressure in the nozzle head during the pre-treatment was 20 kg/cm$^2$. The thus obtained sheet possessed no pores.

The plain-woven net of bronze of 25 mesh was fastened to the surface of a paper-making dandy roll such that the lines of the net defined an angle of 45 degrees with respect to the direction in which the sheet travels in order to form a net screen. While rotating the screen at a surface speed of 15 meters per minute, a columnar water stream of a first stage was injected onto the sheet from two nozzles each having a row of orifices of a porous diameter of 0.15 mm maintaining a pitch of 0.8 mm disposed over the screen. Here, the water pressure in the nozzle heads in the first stage was 30 kg/cm$^2$ in the first nozzle and 60 kg/cm$^2$ in the second nozzle. There was obtained a porous sheet having pores of 25 meshes and in which the fiber bundles were oriented in the biasing direction.

Next, the plain-woven net of bronze of 50 mesh having a wire fineness of 0.3 mm was fastened to the surface of a paper-making dandy roll such that the lines of the net defined an angle of 45 degrees with respect to the direction in which the sheet travels in order to form a net screen. The porous sheet obtained in the first stage was placed on the net screen such that the columnar water stream hit the surface opposite to the surface in the first stage. While rotating the screen at a surface speed of 15 meters per minute, a columnar water stream of a second stage was injected onto the sheet from two nozzles each having a row of orifices of a porous diameter of 0.15 mm maintaining a pitch of 0.8 mm disposed over the screen. In this case, the water pressure in the nozzle heads in the second stage was 80 kg/cm$^2$ in the two nozzle heads.

The thus obtained non-woven fabric possessed a weight of 49 g/m$^2$, a thickness of 0.54 mm, a tensile strength of 12.5 kg/5 cm width in average in the longitudinal direction and in the transverse direction, a tensile elongation of 75% and a shearing stiffness of 2.1 gf/cm.

The non-woven fabric possessed a structure in which a maximum of 25 large fiber bundles intersected per inch, small fiber bundles intersected among the large fiber bundles, and fibers of the fiber bundles entangled among the large fiber bundles, among the small fiber bundles and at intersecting points of the fiber bundles. The non-woven fabric exhibited excellent draping property and possessed a structure in which fiber bundles entered into the pores formed in the first stage creating a closed texture and exhibiting excellent covering property.

EXAMPLE 10

Sixty percent by weight of a split-into-thirteen fiber having the shape of a chrysanthemum in cross section (having a fineness of 2 deniers and a fiber length of 38 mm) composed of a polyamide component which divides the polyester component that is a main component (0.175 deniers after split) into eight wedges, which radially extends from the axes of the fiber, and can be split into one cross (0.3 denier after split) and four lines (0.075 denier after split), and 40% by weight of a polyester fiber (having a fineness of 1 denier and a fiber length of 38 mm), were carded. Then, a unidirectional fiber web and a multi-directional cross-layer fiber web were laminated at a weight ratio of 1 to 2 to obtain a laminated fiber web.

The laminated fiber web was placed on a plain-woven net of 100 mesh and was pre-treated with a water stream of a water pressure of 10 kg/cm$^2$ from a nozzle having orifices of a porous diameter of 0.13 mm maintaining a pitch of 0.6 mm. The laminated fiber web was then placed on a plain-woven net of 50 mesh, treated (first stage) twice with a columnar water stream of a water pressure of 50 kg/cm$^2$ from a similar nozzle. The entangled laminated fiber web was then reversed and was placed on a plain-woven net of 80 mesh, and the opposite surface was treated (second stage) twice with the water stream of a water pressure of 50 kg/cm$^2$ from a similar nozzle to obtain a non-woven fabric having a weight of 25 g/m$^2$ and a thickness of 0.28 mm. The non-woven fabric was suited for use as an interlining.

The thus obtained non-woven fabric possessed a tensile strength of 8.3 kg/5 cm in the longitudinal direction and 5.0 kg/5 cm in the transverse direction, a tensile elongation of 57.3% in the longitudinal direction and 85.1% in the transverse direction, an extension recovery rate of 73.8% in the longitudinal direction and 83.5% in the transverse direction, a bending rigidity of 0.020 gf-cm/cm in the longitudinal direction and 0.007 gf-cm/cm in the transverse direction, and a shearing stiffness of 0.94 gf/cm in the longitudinal direction and 1.15 gf/cm in the transverse direction.

EXAMPLE 11

A laminated fiber web prepared in the same manner as in Example 10 was placed on a plain-woven net of 100 mesh and was pre-treated with a columnar water stream of a water pressure of 15 kg/cm$^2$ from the same nozzle as that of Example 10 and was then placed on a plain-woven net of 25 mesh, and was treated (first stage) twice with a columnar water stream of a water pressure of 80 kg/cm$^2$ The entangled laminated fiber web was then reversed and was placed on a plain-woven net of 50 mesh, and the opposite surface was treated (second stage) twice with the water stream of a water pressure of 80 kg/cm$^2$ from the same nozzle as that of Example 10 to obtain a non-woven fabric having a weight of 35 g/m$^2$ and a thickness of 0.35 mm. The non-woven fabric was suited for use as an interlining.

The thus obtained non-woven fabric possessed a tensile strength of 12.8 kg/5 cm in the longitudinal direction and 6.5 kg/5 cm in the transverse direction, a tensile elongation of 32.1% in the longitudinal direction and 66.8% in the transverse direction, an elongation recovery rate of 71.3% in the longitudinal direction and 80.8% in the transverse direction, a bending rigidity of 0.029 gf-cm/cm in the longitudinal direction and 0.009 gf-cm/cm in the transverse direction, and a shearing stiffness of 1.73 gf/cm in the longitudinal direction and 2.01 gf/cm in the transverse direction.

EXAMPLE 12

A non-woven fabric having a weight of 35 g/m$^2$ and a thickness of 0.35 mm was obtained in the same manner as in Example 11 except that in carrying out the treatment of the second stage, the laminated fiber web that was entangled was not reversed but was treated with the water stream from the same surface as that in the first stage. The non-woven fabric was suited for use as an interlining.

The thus obtained non-woven fabric possessed a tensile strength of 10.8 kg/5 cm in the longitudinal direction and 6.4 kg/5 cm in the transverse direction, a tensile elongation of 41.0% in the longitudinal direction and 72.3% in the transverse direction, an extension recovery rate of 69.8% in the longitudinal direction and 80.5% in the transverse direction, a bending rigidity of 0.024 gf-cm/cm in the longitudinal direction and 0.005 gf-cm/cm in the transverse direction, and a shearing stiffness of 1.11 gf/cm in the longitudinal direction and 1.47 gf/cm in the transverse direction.

EXAMPLE 13

A non-woven fabric having a weight of 35 g/m$^2$ and a thickness of 0.35 mm was obtained in the same manner as in Example 11 with the exception of using, by cotton-mixing, 40% by weight of the split-into-thirteen fiber having the shape of a chrysanthemum in cross section (having a fineness of 2 denier and a fiber length of 38 mm) used in Example 10 and 60% by weight of a polyester fiber (having a fineness of 1 denier and a fiber length of 38 mm). The non-woven fabric was suited for use as an interlining.

The thus obtained non-woven fabric possessed a tensile strength of 12.0 kg/5 cm in the longitudinal direction and 7.9 kg/5 cm in the transverse direction, a tensile elongation of 36.0% in the longitudinal direction and 69.2% in the transverse direction, an extension recovery rate of 73.4% in the longitudinal direction and 77.6% in the transverse direction, a bending rigidity of 0.036 gf-cm/cm in the longitudinal direction and 0.009 gf-cm/cm in the transverse direction, and a shearing stiffness of 1.36 gf/cm in the longitudinal direction and 1.79 gf/cm in the transverse direction.

COMPARATIVE EXAMPLE 5

The procedure was carried out in the same manner as in Example 10 in an attempt to obtain a non-woven fabric having a weight of 12 g/m$^3$. However, the fiber did not entangle and the non-woven fabric was not obtained.

COMPARATIVE EXAMPLE 6

The procedure was carried out in the same manner as in Example 11 to obtain a non-woven fabric having a weight of 50 g/m$^2$ and a thickness of 0.48 mm.

The thus obtained non-woven fabric possessed a tensile strength of 14.7 kg/5 cm in the longitudinal direction and 12.8 kg/5 cm in the transverse direction, a tensile elongation of 25.5% in the longitudinal direction and 51.1% in the transverse direction, an extension recovery rate of 49.8% in the longitudinal direction and 65.7% in the transverse direction, a bending rigidity of 0.049 gf-cm/cm in the longitudinal direction and 0.012 gf-cm/cm in the transverse direction, and a shearing stiffness of 2.83 gf/cm in the longitudinal direction and 1.85 gf/cm in the transverse direction.

COMPARATIVE EXAMPLE 7

A non-woven fabric having a weight of 35 g/m$^2$ and a thickness of 0.40 mm was obtained by placing a laminated fiber web obtained in the same manner as in Example 10 on a plain-woven net of 100 mesh, pre-treating the web with a columnar water stream of a water pressure of 15 kg/cm$^2$ from the same nozzle as that of Example 4, placing the web on a plain-woven net of 50 mesh, and treating the web (first stage) twice with a columnar water stream of a water pressure of 80 kg/cm$^2$ without effecting the treatment of the second stage. The non-woven fabric fluffed so conspicuously that it could not be used as an interlining.

The thus obtained non-woven fabric possessed a tensile strength of 12.9 kg/5 cm in the longitudinal direction and 7.4 kg/5 cm in the transverse direction, a tensile elongation of 39.8% in the longitudinal direction and 89.2% in the transverse direction, an elongation recovery rate of 75.0% in the longitudinal direction and 82.7% in the transverse direction, a bending rigidity of 0.023 gf-cm/cm in the longitudinal direction and 0.007 gf-cm/cm in the transverse direction, and a shearing stiffness of 1.57 gf/cm in the longitudinal direction and 1.88 gf/cm in the transverse direction.

EXAMPLE 14

The non-woven fabric of Example 11 was finished with silicon, expanded by 15% in the transverse direction using a tenter, and was thermally set at 180° C. to obtain a non-woven fabric having a small difference in the strength between the longitudinal direction and the transverse direction.

The thus obtained non-woven fabric possessed a tensile strength of 9.8 kg/5 cm in the longitudinal direction and 8.3 kg/5 cm in the transverse direction, a tensile elongation of 58.2% in the longitudinal direction and 67.7% in the transverse direction, an extension recovery rate of 90.8% in the longitudinal direction and 85.4% in the transverse direction, a bending rigidity of 0.014 gf-cm/cm in the longitudinal direction and 0.009 gf-cm/cm in the transverse direction, and a shearing stiffness of 1.53 gf/cm in the longitudinal direction and 1.42 gf/cm in the transverse direction.

EXAMPLE 15

The non-woven fabric of Example 12 was finished with silicon, expanded by 15% in the transverse direction using a tenter, and was thermally set at 180° C. to obtain a non-woven fabric having a small difference in the strength between the longitudinal direction and the transverse direction.

The thus obtained non-woven fabric possessed a tensile strength of 8.8 kg/5 cm in the longitudinal direction and 7.0 kg/5 cm in the transverse direction, a tensile elongation of 52.7% in the longitudinal direction and 62.8% in the transverse direction, an extension recovery rate of 85.3% in the longitudinal direction and 71.7% in the transverse direction, a bending rigidity of 0.012 gf-cm/cm in the longitudinal direction and 0.008 gf-cm/cm in the transverse direction, and a shearing stiffness of 1.41 gf/cm in the longitudinal direction and 1.31 gf/cm in the transverse direction.

EXAMPLE 16

The non-woven fabric of Example 13 was finished with silicon, expanded by 15% in the transverse direction using a tenter, and was thermally set at 180° C. to obtain a non-woven fabric having a small difference in the strength between the longitudinal direction and the transverse direction.

The thus obtained non-woven fabric possessed a tensile strength of 9.7 kg/5 cm in the longitudinal direction and 8.5 kg/5 cm in the transverse direction, a tensile elongation of 46.7% in the longitudinal direction and 57.3% in the transverse direction, an extension recovery rate of 89.2% in the longitudinal direction and 69.0% in the transverse direction, a bending rigidity of 0.015 gf-cm/cm in the longitudinal direction and 0.008 gf-cm/cm in the transverse direction, and a shearing stiffness of 1.76 gf/cm in the longitudinal direction and 1.69 gf/cm in the transverse direction.

EXAMPLE 17

A paste containing a thermal bonding polyester resin having a melting point of 111° to 118° C. was adhered like dots onto the non-woven fabric of Example 14 by using a screen of a random pattern having 52 dots/cm$^2$ followed by heat treatment at 120° C. for one minute to obtain a non-woven fabric on which the thermal bonding resin was adhered in an amount of 15 g/m$^2$. The non-woven fabric was suited for use as an interlining for adhesion.

The thus obtained non-woven fabric possessed a tensile strength of 9.9 kg/5 cm in the longitudinal direction and 7.5 kg/5 cm in the transverse direction, a tensile elongation of 50.8% in the longitudinal direction and 67.3% in the transverse direction, an extension recovery rate of 89.1% in the longitudinal direction and 93.4% in the transverse direction, a bending rigidity of 0.017 gf-cm/cm in the longitudinal direction and 0.009 gf-cm/cm in the transverse direction, and a shearing stiffness of 1.74 gf/cm in the longitudinal direction and 1.65 gf/cm in the transverse direction.

EXAMPLE 18

A paste containing a thermal bonding polyamide resin having a melting point of 105° to 135° C. was adhered like dots onto the non-woven fabric of Example 15 by using a screen of a random pattern having 37 dots/cm$^2$, followed by the heat treatment at 120° C. for one minute to obtain a non-woven fabric on which the thermal bonding resin was adhered in an amount of 10 g/m$^2$. The non-woven fabric was suited for use as an interlining for adhesion.

The thus obtained non-woven fabric possessed a tensile strength of 9.6 kg/5 cm in the longitudinal direction and 6.2 kg/5 cm in the transverse direction, a tensile elongation of 57.0% in the longitudinal direction and 71.0% in the transverse direction, an extension recovery rate of 80.0% in the longitudinal direction and 92.7% in the transverse direction, a bending rigidity of 0.021 gf-cm/cm in the longitudinal direction and 0.010 gf-cm/cm in the transverse direction, and a shearing stiffness of 1.61 gf/cm in the longitudinal direction and 1.68 gf/cm in the transverse direction.

EXAMPLE 19

A paste containing a thermal bonding polyamide resin having a melting point of 105° to 135° C. was adhered like dots onto the non-woven fabric of Example 16 by using a screen of a random pattern having 37 dots/cm$^2$, followed by heat treatment at 120° C. for one minute to obtain a non-woven fabric on which the thermal bonding resin was adhered in an amount of 10 g/m$^2$. The non-woven fabric was suited for use as an interlining for adhesion.

The thus obtained non-woven fabric possessed a tensile strength of 10.4 kg/5 cm in the longitudinal direction and 8.6 kg/5 cm in the transverse direction, a tensile elongation of 49.6% in the longitudinal direction and 61.4% in the transverse direction, an extension recovery rate of 85.2% in the longitudinal direction and 89.2% in the transverse direction, a bending rigidity of 0.023 gf-cm/cm in the longitudinal direction and 0.013 gf-cm/cm in the transverse direction, and a shearing stiffness of 2.01 gf/cm in the longitudinal direction and 1.73 gf/cm in the transverse direction.

EXAMPLE 20

A non-woven fabric having a weight of 25 g/m$^2$ and a thickness of 0.29 mm was obtained in the same manner as in Example 10 with the exception of using 40% by weight of a cellulose fiber (trade name Tencel, produced by Courtaulds Ltd.) having a fineness of 1.5 deniers and a fiber length of 38 mm obtained by the solvent extraction method, instead of using the polyester fiber of Example 10, effecting the treatment of a first stage using a plain-woven net of 25 mesh with the water pressure of 70 kg/cm$^2$ and effecting the treatment of a second stage using a plain-woven net of 80 mesh with the water pressure of 70 kg/cm$^2$. The non-woven fabric was suited for use as an interlining for adhesion.

The thus obtained non-woven fabric possessed a tensile strength of 9.2 kg/5 cm in the longitudinal direction and 6.1 kg/5 cm in the transverse direction, a tensile elongation of 50.3% in the longitudinal direction and 82.4% in the transverse direction, an extension recovery rate of 70.8% in the longitudinal direction and 82.7% in the transverse direction, a bending rigidity of 0.035 gf-cm/cm in the longitudinal direction and 0.014 gf-cm/cm in the transverse direction, and a shearing stiffness of 1.32 gf/cm in the longitudinal direction and 1.76 gf/cm in the transverse direction.

EXAMPLE 21

A non-woven fabric having a weight of 35 g/m$^2$ and a thickness of 0.34 mm was obtained in the same manner as in Example 11 with the exception of using 40% by weight of a cellulose fiber (trade name Tencel, produced by Courtaulds Ltd.) having a fineness of 1.5 deniers and a fiber length of 38 mm obtained by the solvent extraction method instead of using the polyester fiber of Example 10. The non-woven fabric was suited for use as an interlining for adhesion.

The thus obtained non-woven fabric possessed a tensile strength of 13.3 kg/5 cm in the longitudinal direction and 7.4 kg/5 cm in the transverse direction, a tensile elongation of 34.8% in the longitudinal direction and 60.3% in the transverse direction, an extension recovery rate of 71.4% in the longitudinal direction and 80.5% in the transverse direction, a bending rigidity of 0.047 gf-cm/cm in the longitudinal direction and 0.024 gf-cm/cm in the transverse direction, and a shearing stiffness of 2.14 gf/cm in the longitudinal direction and 2.65 gf/cm in the transverse direction.

EXAMPLE 22

A non-woven fabric on which a thermal bonding polyamide resin was adhered in an amount of 10 g/m$^2$ was obtained in the same manner as in Example 18 after the treatments have been done in the same manner as in Example 14, with the exception of expanding the non-woven fabric of Example 20 in the transverse direction by 10% using a tenter. The non-woven fabric was suited for use as an interlining for adhesion.

The thus obtained non-woven fabric possessed a tensile strength of 10.6 kg/5 cm in the longitudinal direction and 7.3 kg/5 cm in the transverse direction, a tensile elongation of 60.4% in the longitudinal direction and 60.7% in the transverse direction, an extension recovery rate of 88.3% in the longitudinal direction and 92.1% in the transverse direction, a bending rigidity of 0.028 gf-cm/cm in the longitudinal direction and 0.010 gf-cm/cm in the transverse direction, and a shearing stiffness of 1.57 gf/cm in the longitudinal direction and 1.93 gf/cm in the transverse direction.

EXAMPLE 23

A non-woven fabric on which a thermal bonding polyamide resin was adhered in an amount of 10 g/m$^2$ was obtained in the same manner as in Example 18 after the treatments have been done in the same manner as in Example 14, with the exception of expanding the non-woven fabric of Example 21 in the transverse direction by 10% using a tenter. The non-woven fabric was suited for use as an interlining for adhesion.

The thus obtained non-woven fabric possessed a tensile strength of 14.8 kg/5 cm in the longitudinal direction and 9.1 kg/5 cm in the transverse direction, a tensile elongation of 42.3% in the longitudinal direction and 55.7% in the transverse direction, an extension recovery rate of 85.7% in the longitudinal direction and 90.4% in the transverse direction, a bending rigidity of 0.034 gf-cm/cm in the longitudinal direction and 0.015 gf-cm/cm in the transverse direction, and a shearing stiffness of 2.42 gf/cm in the longitudinal direction and 2.85 gf/cm in the transverse direction.

Described below are the testing methods used in the above Examples.

(Testing the Tensile Strength and Tensile Elongation)

The non-woven fabric was cut into a piece of 5×10 cm, held in the chucks of a tensile strength tester (produced by Orientek Co., Japan), and was measured for its tensile strength and tensile elongation at a pulling rate of 100 mm/min. The tensile strength and tensile elongation were measured in both the longitudinal direction and the transverse direction of the non-woven fabric.

(Testing the Extension Recovery Rate)

The non-woven fabric was cut into a piece of 5×20 cm, held in the chucks of a tension tester (trade name UCT-100 produced by Orientek Co., Japan), the distance between the chucks being set to 10 cm, and was pulled by 5 mm (5%) at a pulling rate of 100 mm/min. The chucks were then brought back to their initial positions at the same rate. This operation was repeated 10 times to find a maximum point (L) of extension without the load. Here, 5% extension recovery rate is obtained in compliance with [(5-L)/5]×100. The extension recovery rate of the non-woven fabric was measured in both the longitudinal direction and the transverse direction.

(Testing the Bending Rigidity)

The non-woven fabric cut into a piece of 20×20 cm was set to a pure bending tester (trade name KES-FB2 produced by Kato-Tek Co., Japan) having a gap between the chucks of 1 cm, bent up to a curvature of 2.5 cm and was then bent again in the opposite direction up to a curvature of 2.5 cm. The bending rigidity was found from a change in the bending moment per unit width relative to a change of from a curvature of 0.5 cm to a curvature of 1.5 cm. The bending rigidity of the non-woven fabric was also measured in both the longitudinal direction and the transverse direction.

(Testing the Shearing Stiffness)

The non-woven fabric cut into a piece of 20×20 cm was set to a tensile tester (trade name KES-FB1 produced by Kato-Tek Co., Japan) having a gap between the chucks of 5 cm, and a tension of 10 g/cm was applied thereto. The non-woven fabric was sheared up to a shearing angle of 8 degrees and was then sheared again in the opposite direction up to a shearing angle of 8 degrees. The shearing stiffness was found from a change in the shearing force per unit width relative to a change in the shearing angle. The shearing stiffness of the non-woven fabric was measured in both the longitudinal direction and the transverse direction.

The non-woven fabric of the present invention has excellent draping property, covering property and abrasion resistance and can be used as a simple garment, underwear, medical gown, interlining, interior material, base material for synthetic leathers, impregnated base material and the like.

When the weight is from 15 to 45 g/m$^2$ in particular, the fibers exhibit versatility and excellent draping property, so that the non-woven fabric can be favorably used as an interlining. Furthermore, since the fiber bundles are entangled at the intersecting points, the non-woven fabric exhibits excellent extension recovering property and undergoes only slight plastic deformation.

The non-woven fabric of the present invention exhibits more excellent strength and draping property when it contains not less than 20% by weight of very fine fibers obtained by mechanically splitting the splittable fibers.

The non-woven fabric of the present invention exhibits excellent repelling property when it contains fibers obtained by fibrillating cellulose fibers produced by the solvent extraction method.

The non-woven fabric of the present invention exhibits excellent draping property and extension recovering property and undergoes slight plastic deformation when it has a thermal bonding resin adhered onto at least one surface thereof. In this case, the non-woven fabric can be favorably used as an interlining for adhesion.

What is claimed is:

1. A non-woven fabric formed by a process comprising:

forming a fiber web consisting of staple fiber, first fluid-entangling the fiber web on a first support member having large pores to obtain an intermediate fabric having large fiber bundles that intersect, and further fluid-entangling the intermediate fabric on a second support member having small pores to form small fiber bundles therein, wherein said fiber bundles are coplanar.

2. A non-woven fabric according to claim 1, wherein fibers of said small fiber bundles and said large fiber bundles are branched from said small fiber bundles and said large fiber bundles, and are partly and irregularly oriented and entangled.

3. A non-woven fabric according to claim 1, wherein said fiber web is prepared by a wet-laid method.

4. A non-woven fabric according to claim 1, wherein at least one of said large fiber bundles and said small fiber bundles comprises very fine fibers obtained by splitting splittable fibers.

5. A non-woven fabric according to claim 1, wherein at least one of said large fiber bundles and said small fiber bundles comprises fibers obtained by fibrillating cellulose fibers prepared by a solvent extraction method.

6. A non-woven fabric according to claim 1, wherein at least one of said large fiber bundles and said small fiber bundles comprises latently crimped fibers.

7. A non-woven fabric according to claim 1, wherein at least one of said large fiber bundles and said small fiber bundles comprises heat-shrinkable fibers.

8. A non-woven fabric according to claim 1, further comprising a thermal bonding resin adhered to at least one surface of said non-woven fabric.

9. An interlining comprising the non-woven fabric of claim 1.

10. The non-woven fabric according to claim 1, wherein said first fluid-entangling and said second fluid-entangling uses a columnar stream.

11. The non-woven fabric according to claim 1, wherein water-pressure in said first fluid-entangling and said further fluid-entangling is from about 10 to about 300 kg/cm$^2$.

12. The non-woven fabric according to claim 11, wherein water-pressure in said first fluid-entangling is from about 20 to about 150 kg/cm$^2$.

13. The non-woven fabric according to claim 11, wherein water-pressure in said further second fluid-entangling is from about 30 to about 200 kg/cm$^2$.

14. The non-woven- fabric according to claim 1, wherein said process further comprises expanding said large fiber bundles and said small fiber bundles in the transverse direction, and heat treating the non-woven fabric.

15. The non-woven fabric according to claim 1, wherein said large fiber bundles intersect with one another, said small fiber bundles intersect with one another, fibers of said large fiber bundles are entangled with one another, fibers of said small fiber bundles are entangled with one another and fibers of the large fiber bundles and of the small fiber bundles that intersect with one another are entangled with one another.

16. A non-woven fabric according to claim 1, wherein said small fiber bundles are parallel to said large fiber bundles.

17. A non-woven fabric according to claim 3, wherein fibers of said fiber web are entangled.

18. A non-woven fabric formed by a process comprising:

first fluid-entangling a fiber web on a first support member having large pores to obtain an intermediate fabric having large fiber bundles that intersect, and further fluid-entangling the intermediate fabric on a second support member having small pores to form small fiber bundles therein;

wherein said fiber bundles are coplanar; and wherein said large fiber bundles intersect with one another, said small fiber bundles intersect with one another, fibers of said large fiber bundles are entangled with one another, fibers of said small fiber bundles are entangled with one another and fibers of the large fiber bundles and of the small fiber bundles that intersect with one another are entangled with one another.

19. A non-woven fabric formed by a process comprising:

first fluid-entangling a fiber web on a first support member having large pores to obtain an intermediate fabric having large fiber bundles that intersect, and further fluid-entangling the intermediate fabric on a second support member having small pores to form small fiber bundles therein;

wherein said fiber bundles are coplanar; and wherein fibers of said small fiber bundles and said large fiber bundles are branched from said large fiber bundles to said small fiber bundles, and are partly and irregularly oriented and entangled.

20. A non-woven fabric according to claim 18, wherein at least one of said large fiber bundles and said small fiber bundles comprises very fine fibers obtained by splitting splittable fibers.

21. A non-woven fabric according to claim 18, wherein at least one of said large fiber bundles and said small fiber bundles comprises fibers obtained by fibrillating cellulose fibers prepared by a solvent extraction method.

22. A non-woven fabric according to claim 18, wherein at least one of said large fiber bundles and said small fiber bundles comprises latently crimped fibers.

23. A non-woven fabric according to claim 18, wherein at least one of said large fiber bundles and said small fiber bundles comprises heat-shrinkable fibers.

24. A non-woven fabric according to claim 18, further comprising a thermal bonding resin adhered to at least one surface of said non-woven fabric.

25. The non-woven fabric according to claim 18, wherein said process further comprises expanding said large fiber bundles and said small fiber bundles in the transverse direction, and heat treating the non-woven fabric.

* * * * *